United States Patent [19]

Noland

[11] 4,373,350

[45] Feb. 15, 1983

[54] HEAT PUMP CONTROL/DEFROST CIRCUIT

[75] Inventor: Joseph R. Noland, Louisville, Ky.

[73] Assignee: General Electric Company, Louisville, Ky.

[21] Appl. No.: 282,352

[22] Filed: Jul. 9, 1981

[51] Int. Cl.[3] ..... F25D 21/06

[52] U.S. Cl. ..... 62/156; 165/29

[58] Field of Search ..... 62/156, 151, 160; 165/29

[56] References Cited

U.S. PATENT DOCUMENTS

| | | | |
|---|---|---|---|
| 3,159,981 | 12/1964 | Huskey | 62/156 |
| 3,170,305 | 2/1965 | Dibble et al. | 62/160 X |
| 3,261,395 | 7/1966 | Foster et al. | 165/29 |
| 3,348,607 | 10/1967 | Cootey | 165/28 |
| 3,466,888 | 9/1969 | Kyle | 62/156 |
| 4,024,722 | 5/1977 | McCarty | 62/81 |
| 4,101,391 | 7/1978 | Noland et al. | 165/29 |

*Primary Examiner*—Albert J. Makay
*Assistant Examiner*—Harry Tanner
*Attorney, Agent, or Firm*—Frank P. Giacalone; Radford M. Reams

[57] ABSTRACT

The present invention relates to a self-contained air conditioning unit including a reversible refrigeration system and more particularly to a control system having a plurality of sensing means that are effective in maintaining operation of the unit in a heat pump mode when the ambient and the surface temperature of selected refrigeration components are above a preselected frosting temperature, and to energize a heating means to provide uninterrupted heating when the ambient and surface temperatures sensed are below a preselected frosting level which terminates compressor operation.

2 Claims, 2 Drawing Figures

HEAT PUMP CONTROL/DEFROST CIRCUIT

BACKGROUND OF THE INVENTION

Self-contained air conditioning units of the reversible type which are adapted to be mounted in the outer wall of an enclosure and utilized for heating the air from the enclosure during the winter and cooling the air from the enclosure during the summer comprises a housing divided into an indoor section and an outdoor section. An indoor heat exchanger is disposed in the indoor section while an outdoor heat exchanger and usually the compressor are located in the outdoor section. The compressor is reversibly connected to the heat exchangers so that the indoor heat exchanger functions as an evaporator when the unit is operating on the cooling cycle and the outdoor heat exchanger functions as the evaporator on the heating cycle. Suitable independent fan means are provided for circulating indoor air over the indoor heat exchanger and outdoor air over the outdoor heat exchanger during operation of the system on either the heating or cooling cycle.

Under certain operating conditions, the outdoor heat exchanger functioning as the evaporator may operate at such a low temperature as to cause the accumulation of a coating or layer of frost thereon. Since such a frost layer operates as a barrier to heat transfer between the evaporator and the air being circulated over the evaporator, the efficiency of the unit is markedly reduced. Also, unless means are provided for interrupting this accumulation of frost, the evaporator can become completely filled with a layer of frost which may eventually cause motor or other damage to the unit.

Accordingly, by the present invention, there is provided a self-contained heat pump including control circuitry including a pair of thermostats comprising sensing elements subjected to both ambient and selected component surface temperatures whereby the operation of the heat pump is maintained as long as the temperature sensed by the thermostat is above a preselected frosting level and is interrupted by the coldest preselected temperature sensed by the elements whereby an electric heater is energized to provide uninterrupted heating.

U.S. Pat. No. 3,159,981—Huskey, assigned to the General Electric Company, assignee of the present invention, discloses a self-contained air conditioning unit including a reversible refrigeration system and a control circuitry designed to interrupt the operation of the refrigeration system whenever either the outdoor or indoor heat exchanger attains a frosting temperature and to supply auxiliary heat to an enclosure whenever the operation of the refrigeration system is thus interrupted during a heating cycle. The frost control switch includes a vapor-filled bellows and capillary tube sensing element connected to the bellows. The tube is arranged with a first portion in contact with one of the heat exchangers and a second portion in contact with the other heat exchanger whereby the bellows operated switch will stop the compressor when either heat exchanger attains a frosting temperature.

Another prior art attempt at solving the frosting of the outdoor heat exchanger when in the heating cycle it is operating as an evaporator, is disclosed in U.S. Pat. No. 3,466,888—Kyle. The control circuitry includes a first thermistor in heat exchange contact with the outdoor coil and a second thermistor is exposed to the temperature of the outdoor air. The two thermistors are connected in series. When frost forms on the surface of the outdoor heat exchanger, the temperature of the refrigerant therein decreases, and the voltage at the junction of the thermistor changes, and operates a control circuit which stops the fan of the outdoor coil, and reverses the flow of refrigerant so that the outdoor coil operates as a condenser coil to melt the frost.

U.S. Pat. No. 3,348,607—Cootey discloses a split-bulb or dual-bulb thermostat wherein a sensing element is located in the path of return air and the other in the outdoor or ambient air. The sensing elements are proportioned in size relative to each other and both elements transmit motion to a single power element in response to changes in the temperature of the air effecting the elements.

SUMMARY OF THE INVENTION

The present invention is an improvement of the control system disclosed in U.S. Pat. No. 4,102,391-Noland et al issued July 25, 1978 and assigned to the General Electric Company the Assignee of the present invention, and relates to a self-contained air conditioning unit for heating and cooling an enclosure. The refrigerant system includes an outdoor heat exchanger, an indoor heat exchanger, a compressor, a reversing valve for selectively connecting the compressor to the heat exchangers whereby the outdoor heat exchanger functions as an evaporator during operation of the unit on the heating cycle and the indoor heat exchanger functions as an evaporator during operation of the unit on the cooling cycle, fan means for moving enclosure air through the indoor heat exchanger, and for moving outdoor ambient air through the outdoor heat exchanger.

More particularly, the invention relates to an air conditioner control for preventing excessive frosting of the outdoor heat exchanger by selectively controlling the operation of the refrigeration system, and for energizing auxiliary heating means when the compressor is de-energized and when the refrigeration system cannot maintain a selected comfort level.

The control system includes a first frost control means having a sensing element exposed to the surface temperature of the outdoor heat exchanger, for maintaining operation of the compressor in the heating cycle when outdoor heat exchanger surface temperature is above a preselected frost accumulation level and to de-energize the compressor when the sensing element senses a preselected frost accumulation level, and to energize the auxiliary heating means to provide uninterrupted heating of the enclosure.

A second control including a sensing element for maintaining operation of the outdoor fan independent of the first control when the ambient is above a frost accumulation temperature and to complete a circuit to the fan through the first control if the sensing element of the second control senses a preselected frosting temperature to de-energize the outdoor fan when the compressor is de-energized.

A thermostat means having a first switching means operable for energizing the compressor in the heating cycle when the temperature of the enclosure is at predetermined comfort level, and a second switching means operable for de-energizing the compressor when the temperature of the enclosure drops to a second lower predetermined level during the operation of the compressor in the heating cycle, a heating means is arranged in the path of air through the indoor heat exchanger is energized by the second switching means when the temperature of the enclosure drops to the second lower preselected temperature, and circuit means establishing a circuit through the heating means when the compressor is de-energized by the first frost control to insure that the heating of the enclosure continues uninterrupted during the defrost cycle.

DESCRIPTION OF THE PREFERRED EMBODIMENT

Figure 1:
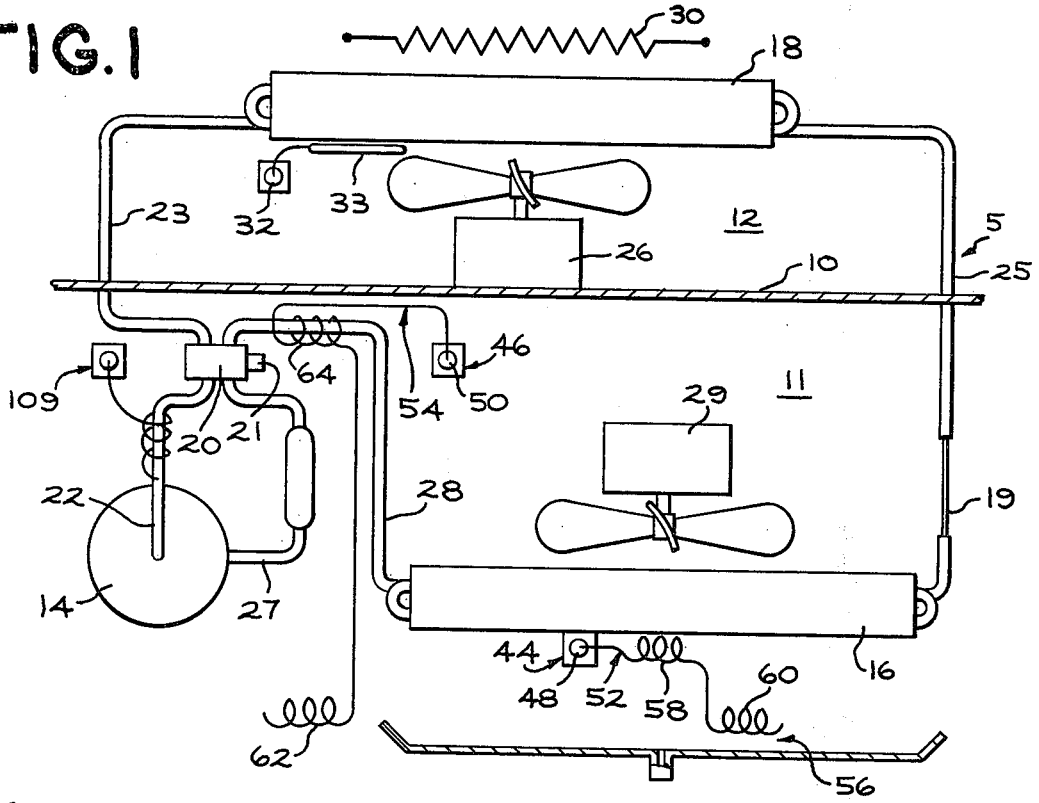
FIG. 1 is a diagrammatic view of a self-contained heat pump air conditioner unit embodying this invention.

Referring to FIG. 1 of the drawing, there is shown schematically an air conditioning unit 5 employing a refrigeration system of the reversible or heat pump type. The unit 5 is divided by means of a partition 10 into an outdoor section 11 and an indoor section 12. The reverse cycle refrigeration system comprises a compressor 14 and an outdoor heat exchanger 16 mounted within the outdoor section 11 and an indoor heat exchanger 18 mounted within the indoor section 12. The outdoor heat exchanger 16 and indoor heat exchanger 18 are connected by means of a suitable flow restriction means such as a capillary tube 19 while the compressor is connected to the heat exchangers through a reversing valve 20 operated by a solenoid 21 so that the indoor heat exchanger 18 and outdoor heat exchanger 16 can be connected to the compressor to function interchangeably either as the evaporator or as the condenser component of a refrigeration system.

During operation of the system as a heat pump or in the heating cycle, the reversing valve 20 directs the flow of high temperature refrigerant gas from the discharge line 22 of compressor 14 through the valve 20 and line 23 into the indoor heat exchanger 18 which then functions as a condenser to warm the air to be conditioned, and to condense the refrigerant gas into liquid form. The refrigerant is partially or completely condensed by the air circulated through the indoor heat exchanger 18 by fan 26. The refrigerant then flows through line 25 including expansion device 19 to the outdoor heat exchanger which is now functioning as an evaporator. The gaseous refrigerant then flows back through valve 20, suction line 27, and into the compressor 14.

During operation of the system in the cooling cycle, high pressure refrigerant gas is directed by the reversing valve 20 into the outdoor heat exchanger 16 through a line 28 where the high pressure refrigerant gas is condensed by the air circulated through heat exchanger 16 by fan 29. The refrigerant then flows through line 25 including expansion device 19 to the indoor heat exchanger 18 which is now functioning as an evaporator and then back through line 23, valve 20, suction line 27 and into the compressor 14.

An auxiliary heater in the form of an electrical resistance heater 30 is preferably provided in the indoor section in the path of air flowing through the indoor heat exchanger 18 for the purpose of supplying heat to the airstream under certain operating conditions when heat supplied by the indoor heat exchanger 18 operating as a condenser cannot satisfactorily maintain the enclosure being heated at a preselected temperature.

Positioned within the unit at some point in the airstream upstream from the heat exchanger 18 is a staged thermostat 32 which controls the operation of the unit on either the heating or the cooling cycle. This thermostat 32 may be of the type well known in the art and, as employed in the present embodiment of the invention, includes sensing means 33 responsive to the temperature of the indoor air for actuating first stage switching means 34 and second stage switching means 36 of thermostat 32 shown in the control circuit (FIG. 2) in a manner to be fully explained hereinafter. In the illustrated embodiment of the invention, this temperature responsive means 33 is arranged in the airstream flowing from the enclosure and into the indoor section. The unit is also provided with a main or selector switch 38 (FIG. 2) through which electrical supply from supply lines 40—42 is connected to the unit and by means of which the operator of the unit may select operation thereof of the unit on either the heating or the cooling cycle.

The unit also includes a pair of frost control thermostats or switches 44 and 46 which may be conveniently mounted on the outdoor section 11 and which are activated by a vapor-filled bellows 48, 50 respectively, and include capillary tube sensing elements 52, 54 connected to the bellows 48, 50 respectively.

The sensing element 52 of switch 44 is arranged to maintain operation of the refrigeration system compressor 14 energized in the heat pump mode when the drain area 56 and surface temperature of heat exchanger 16 are both above a preselected frost accumulation level, and to interrupt the operation of the compressor 14 whenever either heat exchanger 16 or the temperature of drain area 56 indicates an excessive frosting condition or temperature during operating of the unit on the heating cycle. To this end, the capillary sensing element 52 is arranged so that it includes a first portion 58 which continuously senses the temperature of the outdoor heat exchanger 16 and a second portion 60 which continuously senses the temperature of the drain area 56, and more particularly the presence of ice.

The sensing element 54 of switch 46 is arranged to maintain operation of the outdoor fan motor 29 when the temperature of the relatively cold line 28 in the heating mode and the ambient outdoor temperature are both above the freezing range, and to interrupt operation of the fan 29 when either line 28 or the ambient temperature is below freezing temperature, when the unit is on in the heating cycle and control 44 has interrupted operation of the compressor 14. To this end, the capillary sensing element 54 is arranged so that it includes a first portion 62 which continuously senses the outdoor or ambient temperature and a second portion 64 which continuously senses the temperature of the line 28 adjacent the reversing valve 20.

As is well known, a vapor-filled capillary-bellows type of thermostat has the characteristic of controlling from the coldest point of the bellows-capillary system due to the fact that a vapor-liquid boundary is formed at the coldest point and this boundary establishes the vapor pressure of the capillary-bellows system. Hence, the operation of the frost control switch 44 will be controlled by either of its sensing portions 58, 60 depending on which is colder, while the operation of the frost control switch 46 will be controlled by either of its sensing portions 62, 64 depending on which is colder.

While in the preferred embodiment of the invention disclosed, vapor-filled capillary-bellows type thermostat controls have been used successfully, it should be understood that other controls and components may be employed that provide control from the coldest point sensed.

Generally, during repeated defrosting cycles, ice will re-form in the drain area quickly since it is the last place to melt or leave the drain area. Accordingly, positioning portion 60 adjacent the drain 56 will, since thermostat switch member 44 does not trip until 35° F. is sensed, assures that all of the ice has melted from the drain area and in fact water is running through the drain. However, it may be possible that other points or areas of the unit could provide adequate temperature readings relative to ice or frost accumulation; for example, any area where ice or frost could normally accumulate in a unit.

Figure 2:
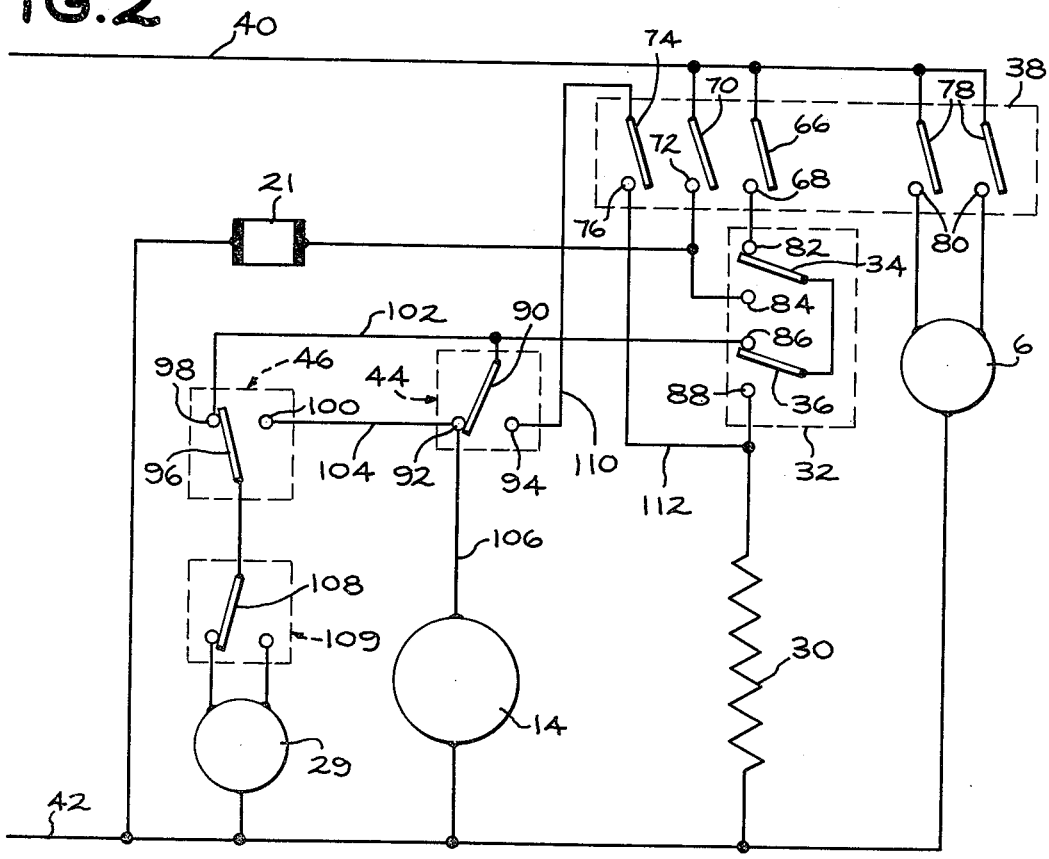
FIG. 2 is a simplified schematic diagram of electrical control circuitry adapted to control the unit in accordance with the present invention.

For a more complete understanding of the control circuitry, and the manner in which frost buildup is controlled, reference is made to the wiring diagram shown in FIG. 2 of the drawing. As mentioned hereinbefore, the main or selector switch 38 allows energization of the air conditioning unit, and selects the operation thereof on either the heating or cooling cycle. Switch 38 includes a cooling switching means 66 movable relative to a cooling contact 68 and a heating switching means 70 movable relative to contact 72 and a second heating switching means 74 that is movable relative to a contact 76 and by which the operation of the unit on either the cooling cycle or the heating cycle can be selected. Switch 38 also provides a circuit through a switch 78 and its contacts 80 to selectively operate the indoor fan motor 26 on high or low fan speed.

In operation with the selector switch 38 in the heat position, a circuit is completed from line 40 through contact 72, solenoid 21 to activate the reversing valve 20 thereby placing the refrigeration system in the heat pump mode. Cooling contact 68 and heating contact 72 of selector switch 38 are connected to cooling and heating contacts 82, 84 respectively, of the first stage switch 34 of thermostat 32. Accordingly, the switching means 34 of thermostat 32 is arranged to supply power to the remaining control circuit through contact 82 in the cooling mode and contact 84 in the heating mode. Thermostat 32 is also provided with second stage switching means 36 electrically connected to switching means 34. The switching means 36 is movable between a contact 86 which controls operation of the compressor 14 and outdoor fan motor 29 through controls 44 and/or 46, and a contact 88 which controls operation of heater 30.

Power from supply line 40 passes through second stage switch means 36 and contact 86 of thermostat 32 to the switching means 90 of the frost control 44. The switching means 90 is movable between a contact 92 arranged to be closed above a preselected temperature (35° F.) and contact 94 arranged to be closed below a preselected temperature (10° F.). It should be noted that the indoor fan 26 will run continuously at its preselected speed during operation of the unit on either the heating or the cooling cycle. The switching means 96 of frost control 40 which controls the operation of the outdoor fan motor 29 is arranged to move between an upper temperature (35° F.) contact 98 and a lower temperature (30° F.) contact 100. Accordingly, power is supplied to contact 98 through switching means 36 from contact 86 of thermostat 32 through line 102, while contact 100 receives power from contact 42 of control 38 through line 104.

In operation, when the drain area 56 sensed by portion 60, and the surface temperature of heat exchanger 16 sensed by portion 58 of capillary 52 are both above a preselected upper or frost accumulation temperature, a circuit is completed through control 44, switch means 90, contact 92, line 106, and compressor 14, to energize the refrigeration system in the heat pump mode. In the event that the ambient or outdoor temperature sensed by portion 62 and the temperature of the line 28 adjacent the valve 20 sensed by portion 64 of capillary 54 are both above a preselected upper or frost producing temperature, a circuit is completed from line 102, contact 98, switch means 96, fan speed selector 109, to energize the outdoor fan motor 29. While the control circuit includes a fan speed selector 108 switch capable of modulating between a high and low fan speed, determined by compressor outlet line temperature sensed by sensor 109, it should be noted that the frost control system of the present invention is not dependent on modulating the outdoor fan speed and, accordingly, the use of a fan speed selector switch is optional.

In the event either portion 58 or 60 of capillary 52 senses a predetermined frost accumulation temperature in the heating mode, the bellows 48 will cause the switching means 90 to move from contact 92 to contact 94. The function of contact 94 will be explained in detail later in conjunction with the present invention. The circuit to the compressor 14 in this instance will be broken, thereby de-energizing the refrigeration system to prevent additional frost from forming on heat exchanger 16. If, during the time the control 44 is positioned by a frosting temperature to de-energize the compressor 14, either of the portions 62, 64 of capillary 54 sense a low frost producing temperature, the bellows 50 will cause switching means 96 of switch 46 to move from contact 98 to contact 100, so that the outdoor fan will be de-energized.

It should be noted that the surface temperature of the heat exchanger 16 and line 28 adjacent the valve 20 will normally be colder than ambient when the unit is operating in the heat pump mode. Accordingly, portions 58 and 64 will sense the frost producing temperature and in effect be the controlling point. With regard to the operation of outdoor fan motor 29, the portion 64 sensing the colder temperature of line 28 has caused switching means 96 to de-energize the fan motor 29. In this situation, the relatively warm operating temperatures of the discharge line 22 of the compressor 14 will migrate or be transferred through the reversing valve 20 to the portion of the line 28 that is provided with element 64, so that the temperature sensed by portion 64 will very quickly be above the frost producing level, causing switch means 96 to switch to contact 98, provided portion 62 is above preselected temperature, and once again energize fan motor 29 to raise the temperature of heat exchanger 16 relative to ambient to eliminate any frost that may have collected on the surface of heat exchanger 16. The operation of the outdoor fan 29 at this time is beneficial in that by raising the surface temperature of the heat exchanger so that the surface temperature of heat exchanger 16 is once again above the preselected frost producing temperature, causing switch means 90 to move to contact 92 so that the compressor 14 will be energized and the refrigeration system will operate in the heat pump mode to maintain the comfort level selected by the thermostat 32. Operation of, or energization of, heater 30 is controlled by switching means 36 through its contact 88 and by switching means 90 through contact 94 after the compressor is de-energized as will be explained fully.

While operation of the control circuit is controlled by the upper and lower temperatures sensed by the capillaries 52 and 54, it should be noted, however, that the exact temperatures selected may vary depending on several factors, including geographic location of the unit and the exact location of the portions 58 and 64 relative to the refrigeration components. The frost control system of the present invention has been successfully carried out when the temperature range of control 44 was between a high of 35° F. and a low of 10° F. with a temperature swing of 25° F., and the temperature range of control 46 was between a high of 35° F., and a low of 20° F., with a temperature swing of 5° F.

In summary, the switching means 90 will complete a circuit through contact 92 when both the surface temperature of heat exchanger 16 and the ambient air are above 35° F. and will switch to open the contacts to de-energize the compressor if either gets down to 10° F., keeping in mind, however, that the surface temperature of heat exchanger 16 will be lower than ambient. With regard to switching means 96, a circuit to the fan motor 29 will be completed through contact 98 when both the surface temperature of line 28 and the ambient are above 35° F. and will switch to contact 100 if either gets down to 25° F. to de-energize the fan motor 29 only if control 44 has sensed a frost producing 10° F. temperature. If control 44 has not sensed a frost producing temperature then the fan motor will continue to operate through line 104.

In operation, regarding the function of the two-stage thermostat 32 when the temperature of the enclosure being heated in the heat mode reaches a predetermined comfort level, switching means 34 moves away from contact 84 while switching means 36 remains in contact with 86 as shown in FIG. 2. In this situation, the circuit to the compressor 14 is open and the heating operation is interrupted. In the event the temperature drops below the predetermined comfort level, the switching means 34 will engage contact 84 energizing compressor 14 to supply heat in the heat pump mode.

If the temperature of the area being heated drops while the compressor is energized, then switching means 36 will move from contact 86 to de-energize the compressor 14 and close a circuit through contact 88 thereby energizing heater 30. The above operation or heating cycle is repeated in reverse as the temperature in the area to be heated rises, switching member 36 will move from contact 88 to de-energize heater 30 and close on contact 86 to energize the compressor 14. A further rise in temperature to the predetermined comfort level will move switching means 34 from contact 84 to contact 82 to de-energize the compressor 14.

In effect during those periods of time when switch member 36 is on contact 86 and switch member 90 has moved away from contact 92, the resistance heater 30 would remain de-energized and accordingly the heating mode interrupted.

Up to this point in the description of the control system employed in controlling operation of the air conditioning unit with the exception of heat switch 74 and contact 94 of switch 44 has been similar to that disclosed in the above-mentioned U.S. Pat. No. 4,102,391.

By the present invention, means are provided to insure that heating of the enclosure continues, uninterrupted when the compressor is de-energized and the unit goes into defrost. Circuit means are provided that cause the resistance heater 30 to be is energized whenever the frost control thermostat 44 terminates compressor operation and the selector switch 38 is in the heating cycle.

As mentioned hereinabove with the thermostat switch 36 on contact 86 and the circuit to the compressor broken by switch arm 90 moving away from contact 92 the heating cycle is interrupted until the indoor ambient drops further and the thermostat switch arm 36 moves to contact 88 establishing a circuit to the heater 30.

To this end, when control 44 senses a frost accumulation temperature and switch means 90 moves away from contact 92 to terminate operation of the compressor 14 and into engagement with contact 94, a circuit is provided to energize heater 30 through heating switch 74. This completes a circuit to the heater 30 from contact 94 through line 110, through heat switch 74 of the selector switch 38, thence through line 112, heater 30 to line 37. Current from line 36 to switch means 90 follows the circuit described hereinabove through the first and second stage switch means 34 and 36 of thermostat 32.

The above operation, with the use of a two-stage thermostat provides fully automatic switch over from heat pump refrigerant mode to electric resistance heat during those times that the system in the heat pump mode cannot provide sufficient heat to satisfy the room thermostat set at a predetermined comfort level and wherein the system goes into a different mode, and to provide heat when the unit goes into a defrost mode as long as the selector switch 38 has been arranged in the heating mode with switches 70 and 74 closed.

It should be apparent to those skilled in the art that the embodiment described heretofore is considered to be the presently preferred form of this invention. In accordance with the patent statutes, changes may be made in the disclosed apparatus and the manner in which it is used without actually departing from the true spirit and scope of this invention.

What is claimed is:

1. In a self-contained air conditioning unit for heating and cooling an enclosure, a refrigerant circuit including an outdoor heat exchanger and indoor heat exchanger, a compressor, a reversing valve for selectively connecting said compressor to said heat exchangers whereby said outdoor heat exchanger functions as an evaporator during operation of said unit on the heating cycle and said indoor heat exchanger functions as an evaporator during operation of said unit on the cooling cycle, fan means for moving enclosure air through said indoor heat exchanger, fan means for moving outdoor ambient air through said outdoor heat exchanger, an air conditioner heating cycle control system comprising:

a mode selection switch means for placing said air conditioning unit in said heating or cooling cycle;

a thermostat means having a first stage switching means operable for energizing said compressor in said heating cycle when the temperature of said enclosure is a predetermined comfort level, and a second stage switching means operable for de-energizing said compressor when the temperature of said enclosure drops to a second lower predetermined level during the operation of said compressor in said heating cycle;

a heating means arranged in the path of air through said indoor heat exchanger being energized by said second stage switching means when the temperature of said enclosure drops to the second lower preselected temperature;

a frost control means including a sensing element being exposed to the surface temperature of said outdoor heat exchanger, switch means under control of said sensing element movable between a first position for maintaining operation of said compressor in the heating cycle when said heat exchanger surface temperature sensed by said portions are above a preselected frost accumulation level and being movable to a second position for de-energizing said compressor when either of said sensing elements sense a preselected frost accumulation level to place said unit in a defrost mode and including circuit means operable when said frost control switch means is in the second position for energizing said heating means through said mode selection switch and said thermostat first stage switching means thereby energizing said heater at the start of said defrost mode to provide uninterrupted heating when said compressor is de-energized by said frost control means; and a second control including a sensing element having one portion being exposed to said ambient outdoor temperature means under control of said sensing element for maintaining operation of said outdoor fan independent of said first control when the ambient sensed by said sensing element is above a frost accumulation temperature and to complete a circuit to said fan through said first control if said sensing element of said second control senses a preselected frosting temperature to de-energize said outdoor fan when said compressor is de-energized.

2. The self contained air conditioning unit as recited in claim 1 where said mode selection switch further includes a first heat switch means to provide a circuit through said first and second stage switching means, and a second heat switch means arranged in series flow relationship with said second position of said frost control switch means and said heating means.

* * * * *